US007841405B2

(12) United States Patent
Keller

(10) Patent No.: US 7,841,405 B2
(45) **Date of Patent: *Nov. 30, 2010**

(54) FLEXIBLE BOREHOLE LINER WITH DIFFUSION BARRIER AND METHOD OF USE THEREOF

(76) Inventor: Carl Keller, 6 Easy St., Santa Fe, NM (US) 87504

( * ) Notice: Subject to any disclaimer, the term of this patent is extended or adjusted under 35 U.S.C. 154(b) by 613 days.

This patent is subject to a terminal disclaimer.

(21) Appl. No.: 11/800,193

(22) Filed: May 4, 2007

(65) Prior Publication Data

US 2007/0260439 A1 Nov. 8, 2007

Related U.S. Application Data

(60) Provisional application No. 60/798,351, filed on May 5, 2006.

(51) Int. Cl.
*E21B 47/00* (2006.01)
*E21B 49/08* (2006.01)

(52) U.S. Cl. ..... 166/264; 166/242.2; 166/207

(58) Field of Classification Search ..... 166/264, 166/242.2, 380, 207
See application file for complete search history.

(56) References Cited

U.S. PATENT DOCUMENTS

| | | | | |
|---|---|---|---|---|
| 2,812,025 | A * | 11/1957 | Teague et al. | 166/207 |
| 5,176,207 | A | 1/1993 | Keller | |
| 5,377,754 | A | 1/1995 | Keller | |
| 5,725,055 | A * | 3/1998 | Schirmer et al. | 166/264 |
| 5,803,666 | A | 9/1998 | Keller | |
| 5,853,049 | A | 12/1998 | Keller | |
| 6,026,900 | A | 2/2000 | Keller | |
| 6,109,828 | A | 8/2000 | Keller | |
| 6,244,846 | B1 | 6/2001 | Keller | |
| 6,283,209 | B1 | 9/2001 | Keller | |
| 6,298,920 | B1 | 10/2001 | Keller | |
| 6,910,374 | B2 | 6/2005 | Keller | |
| 7,281,422 | B2 | 10/2007 | Keller | |
| 2004/0065438 | A1 | 4/2004 | Keller | |
| 2005/0172710 | A1 | 8/2005 | Keller | |
| 2008/0142214 | A1 | 6/2008 | Keller | |

OTHER PUBLICATIONS

U.S. Appl. No. 12/001,801, filed Dec. 13, 2007, to Keller.
U.S. Appl. No. 12/287,981, filed Oct. 15, 2008, to Keller.

* cited by examiner

*Primary Examiner*—Kenneth Thompson
*Assistant Examiner*—Cathleen R Hutchins
(74) *Attorney, Agent, or Firm*—Rod D. Baker

(57) ABSTRACT

A flexible bore hole liner, such as may be used to line or seal a hole drilled into the earth's surface, and featuring a diffusion barrier to prevent undesirable cross-contamination during, for example, sampling of subsurface fluids. The sampling liner includes a flexible diffusion barrier so as to reduce diffusion transport of contaminant(s) into and/or out of the interior volume of a bore hole liner. This flexible diffusion barrier may be incorporated into the construction of a portion of known borehole liner systems. The diffusion barrier is attached by a suitable means to the liner and/or the "spacer" accompanying the liner. The diffusion barrier prevents diffusion into and/or out of the liner in the sampling interval subtended by the spacer length, preventing cross-contamination of fluid samples obtained by the liner systems currently in use.

8 Claims, 6 Drawing Sheets

FLEXIBLE BOREHOLE LINER WITH DIFFUSION BARRIER AND METHOD OF USE THEREOF

CROSS-REFERENCE TO RELATED APPLICATIONS

This application claims the benefit of the filing of U.S. Provisional Patent Application Ser. No. 60/798,351, filed by this inventor on May 5, 2006, and the specification thereof is incorporated herein by reference.

BACKGROUND OF THE INVENTION

1. Field of the Invention (Technical Field)

The present invention relates to flexible borehole liners, including flexible borehole liners used to effectuate pore fluid sampling and other similar uses, and more particularly to the sealing capability of everting liners in subsurface boreholes.

2. Background Art

Flexible borehole liners are now in commercial use for sealing boreholes and providing isolation for discrete spatial resolution of ground water sampling. General descriptions of the technology may be found on the World Wide Web at www.flut.com. U.S. Pat. Nos. 5,176,207 and 5,725,055 also offer examples of borehole flexible liner methods and apparatuses. The interior pressure of a liner is maintained to be greater than the pore pressure in the medium adjacent to the borehole, thus forcing the liner fabric against the borehole wall to achieve a seal of the borehole against flow into and along the hole.

However, a concern remains with the function of the borehole liner as a sealing device for very long time periods. That concern stems from the molecular diffusion processes. As is well known, molecular diffusion allows the relatively slow transport of contaminants, in solution, through thin barriers from a high concentration volume into an adjacent lower concentration volume. A relevant diffusion process is discussed in U. S. Pat. No. 5,804,743.

In a like manner, tri-chloro-ethylene, and similar contaminants of ground water, can migrate via diffusion from the ground water external to a borehole, through a flexible liner material, and into the interior of the fluid-filled liner. Such diffusion may compromise or defeat the purpose of the liner, which is intended generally to seal the borehole against contamination migration. In time, the diffusion process may propagate the contaminant along the liner length to other locations interior to the fluid-filled liner. Thereafter, diffusion out of the liner into the surrounding medium may contaminate the pore fluids of the medium outside of the liner, remotely from the point(s) of diffusion into the liner interior. This particular diffusion transport path, i.e., 1) into the liner, 2) along the liner, and 3) out of the liner, can bypass the seal against contaminant transport otherwise expected to be achieved by the pressurized liner.

SUMMARY OF THE INVENTION (DISCLOSURE OF THE INVENTION)

There is disclosed herein a pore fluid sampling liner including a very flexible diffusion barrier so as to nearly eliminate the concern about diffusion transport of contaminant(s) into and/or out of the interior volume of a borehole liner. This flexible diffusion barrier may be incorporated into the construction of a portion, called a "spacer," of known borehole liner systems. A spacer normally functions to prevent the seal, by the liner, of a short portion of the subject borehole. That unsealed interval defines the interval of the hole from which a sample of pore fluid is drawn in the sampling procedure. The spacer must be flexible and attached to the liner in order to be everted with the liner as it is emplaced in the borehole. The diffusion barrier preferably is attached by a suitable means to the inner surface of the spacer, which in turn lies against the outer surface of the liner. A spacer with a diffusion barrier prevents diffusion into and/or out of the liner in the interval subtended by the spacer length. For reasons further explained herein, such geometry prevents most of the diffusion of concern, to eliminate cross-contamination of the pore fluid samples obtained by the liner systems currently in use.

Such a diffusion barrier also reduces the concern of cross contamination via the liner interior. Furthermore, the diffusion barrier of the present disclosure prevents other potentially significant diffusion effects, even when transport along the interior of the liner is not significant. An important additional advantage of one type of diffusion barrier is that it reduces the normal friction of the liner and spacer components at the point of eversion of the liner. The friction reduction allows the liner installation by eversion with a lower driving pressure than is normally required with known everting liner systems.

Thus, a primary object of the present invention is to minimize or eliminate diffusion transport of contaminants into or out of a subsurface or "down-hole" flexible liner Other objects and novel features, and further scope of applicability of the present invention will be set forth in part in the detailed description to follow, taken in conjunction with the accompanying drawings, and in part will become apparent to those skilled in the art upon examination of the following, or may be learned by practice of the invention.

BRIEF DESCRIPTION OF THE DRAWINGS

The accompanying drawings, which are incorporated into and form a part of this specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS (BEST MODES FOR CARRYING OUT THE INVENTION)

The present disclosure is of a pore fluid sampling liner method and apparatus, including a flexible diffusion barrier to reduce or prevent diffusion transport of contaminant(s) into and/or out of the interior volume of a bore hole liner. U.S. Pat. No. 6,910,374, incorporated herein by reference, describes the installation of a flexible liner by eversion for the purpose of measuring flow paths from a bore hole. Useful reference is had to the '374 Patent for background understanding of the general practice, and purposes, of deploying everting flexible liners into bore holes. Succinctly described, everting liners are made from flexible, impermeable material in the shape of a collapsible tube. The liner first is "inside out," and an end thereof is attached to the casing head of a subsurface bore hole. The liner is then "everted" (turned "right-side-out") down the borehole by the pressure of some driving fluid. As the liner everts down the borehole, it is pressed against the inside walls of the hole, thereby isolating the interior of the bore hole from the material(s) in situ and exterior of the bore hole. (A simple alternative would be to fill the liner with a lean cement or perhaps with a bentonite slurry. However, such fill materials may prevent or complicate the installation or removal of the liner.)

In this disclosure, "fluid" has its ordinary meaning; it is contemplated that the fluid(s) of interest in the practice of the invention will usually be water (and substances dissolved and/or suspended therein), but the invention is not so limited. Further, a "bore hole" according to the following disclosure may be any hole, conduit or tunnel, such as a pipeline, although the present apparatus and method are most suited for use in holes drilled below the surface of the Earth.

Figure 1:
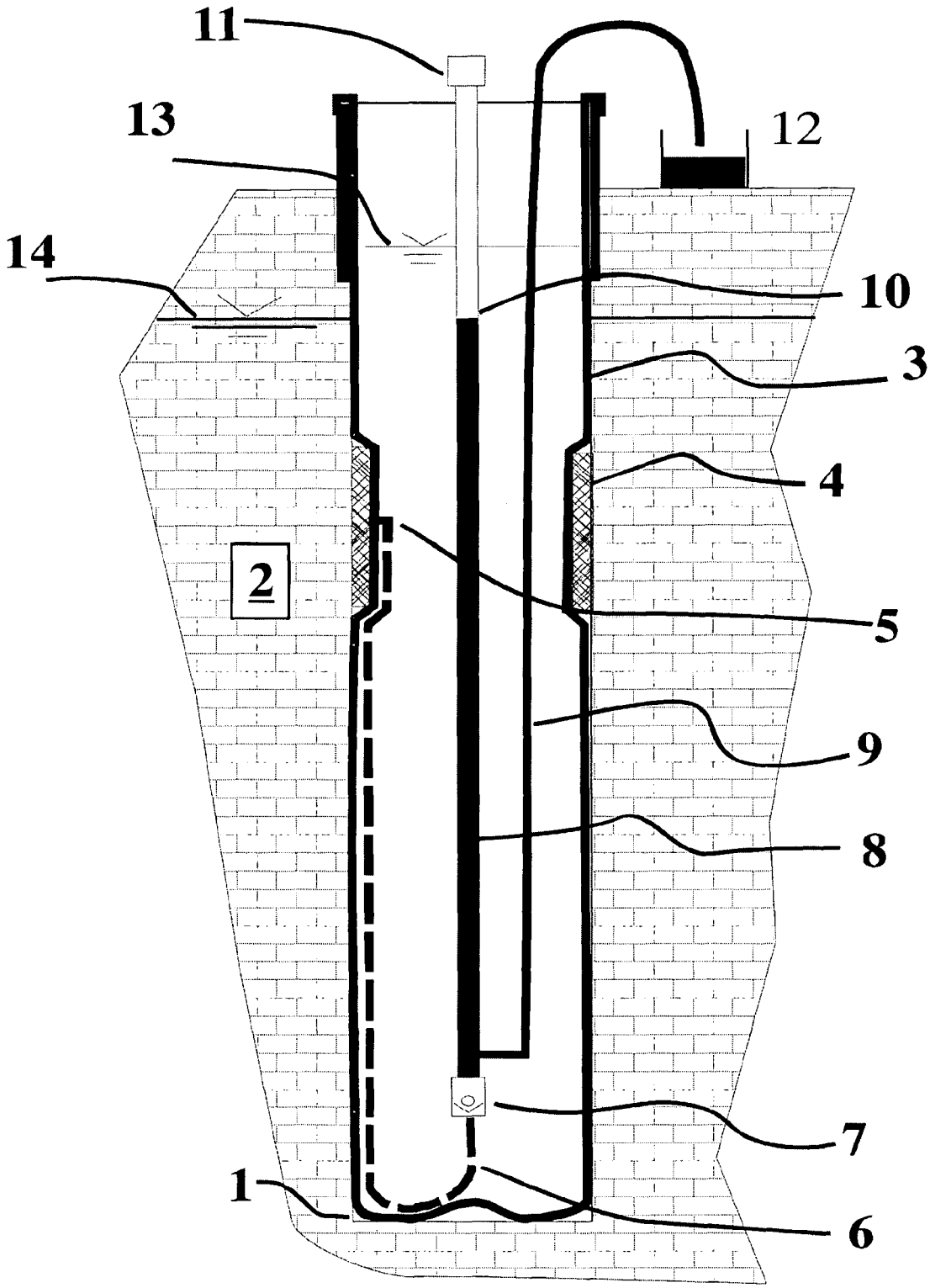
FIG. 1 is a schematic sectional view of a fluid sampling liner system with (for clarity of illustration) a single spacer and sampling port, shown deployed into a bore hole in the ground's subsurface.

Flexible liners in boreholes have been configured as illustrated in FIG. 1 for the purpose of extracting a groundwater sample by gas displacement of the water in the tubing. A feature of the sampling system is the purity of the sample as representative of the groundwater condition in the geologic formation 2 in which the bore hole 1 is formed. The bore hole liner 3 is filled with water, or some other suitable fluid, to provide an interior pressure greater than the pressure in the formation 2, thus urging the liner against the bore hole wall, thus affecting a good seal of the bore hole. The sealing liner 3 prevents migration of contaminated ground water into the bore hole 1. In a sampling regime, it is important that the pore water in the geologic formation 2 at one sampling location is not mixed with the groundwater being sampled at a different location via the bore hole. Sampling locations are provided with a spacer 4 in the bore hole.

Figure 2:
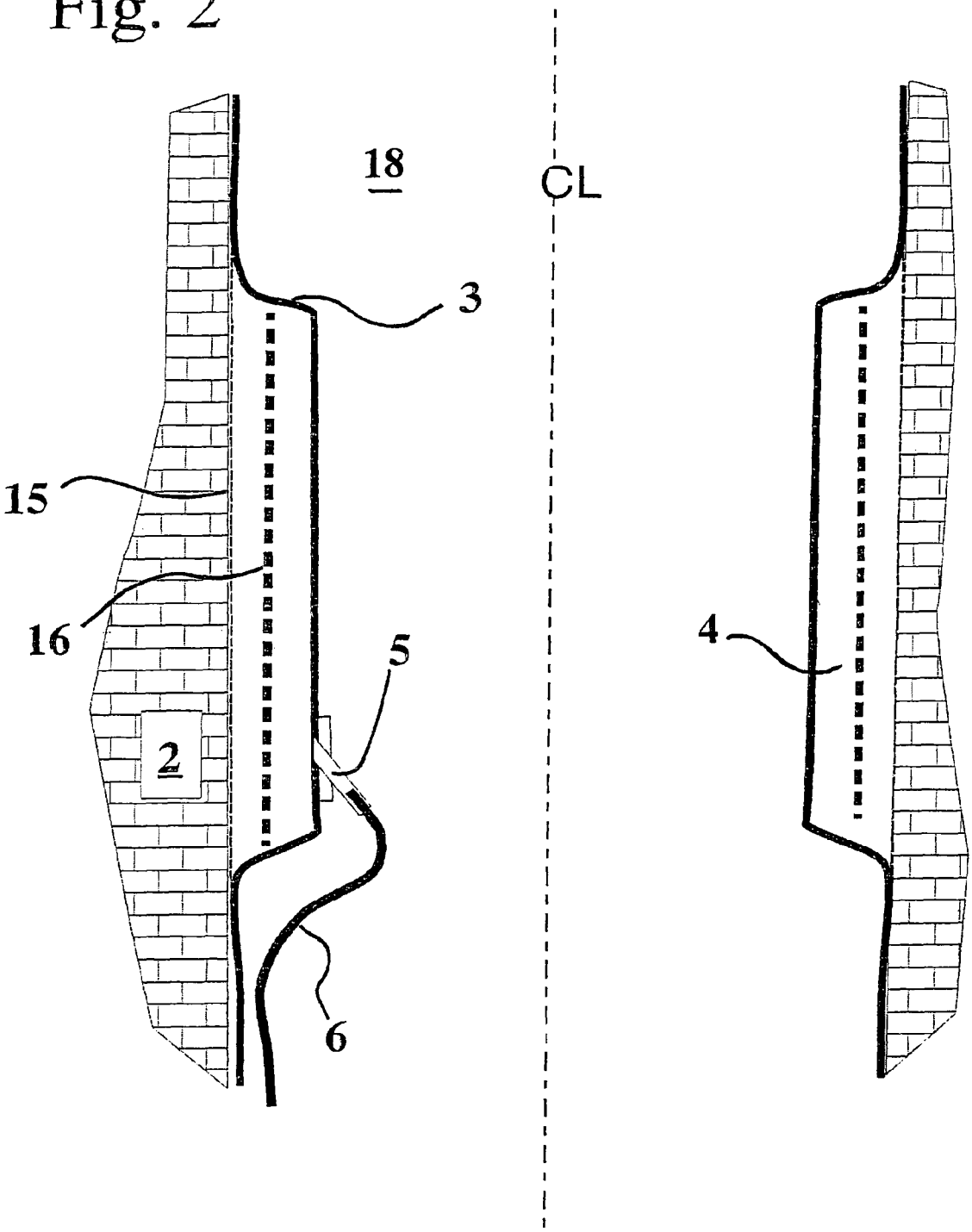
FIG. 2 is a view of a portion of the system depicted in FIG. 1, enlarged to offer a more detailed disclosure of the spacer components included in the system.

FIG. 2 shows a typical "spacer" used to prevent the liner 3 from sealing a short length of the bore hole 1 at a sampling port 5. One or more spacers are disposed at predetermined intervals along the length of a liner 3, the liner being disposable down a bore hole according to known conventions. Spacers generally are known in the art, and a spacer 4 according to the present method and system is flexible, and securely connected to the liner 3 so as to accompany the liner as the latter is disposed, by eversion, down the bore hole 1. With the liner installed down the bore hole, a spacer accordingly is located, by design, at those elevations of the bore hole where sampling is desired.

Whereas there are numerous spacer designs, they may include an outer filter layer 15, an interior permeable mesh 16 open to water or gas flow, and a port 5 through the liner 3. A spacer 4 defines a spacer volume therein into which a fluid may flow and fill. The port 5 is used to extract a sample of the subsurface pore water within the spacer volume, as extracted from the pore space of the nearby formation 2. Due to the short travel distance from the interior of the liner 3, through the liner, and into the interstitial space of the spacer's permeable mesh 16, the diffusion of contamination through the liner can compromise the integrity and reliability of the sample in or near the spacer 4; once contaminated, the sample is no longer accurately representative of the groundwater in situ.

The water fill within the liner interior 18 may provide a pathway for contamination found at one elevation in the bore hole to propagate to another sampling elevation in the same bore hole. (Only one sampling elevation is depicted in FIG. 1.) Such an undesirable pathway may be provided by the slow diffusion of contamination from the ground water at one sampling interval, through the liner material, into the water within the liner interior, then up or down the water-filled interior of the liner, and then out through the liner into the formation adjacent to a different sampling interval. While this diffusion process is very slow, in some situations of very high contamination at one port, a significant amount of contamination by means of diffusion can occur at an adjacent port which may otherwise not produce any contaminated water.

The present disclosure describes a barrier apparatus and method which serves several functions. One is related to preventing the diffusion process described. A second desirable function, realized in actual use, is to provide a lubricating surface on the liner exterior, which reduces the friction of the eversion process while the liner is everting into position in a borehole. A third advantage of the apparatus and method is to prevent the contamination of the surrounding pore fluids by diffusion of contaminants entrained in some flexible liner materials during their manufacture. Prevention of that diffusion from the liner itself allows the use of liner materials that would otherwise conflict with the pore fluid sample integrity as representative of the natural pore fluid.

A central aspect of the present disclosure is to provide a diffusion barrier which prevents a communication of one sampling interval with another sampling interval via contaminating diffusion. The fundamental installation and removal are implemented by means of inverting the liner, generally in accordance with the teachings of U.S. Pat. No. 6,910,374. The present apparatus provides a diffusion barrier that is thin, flexible, and very resistant (or impermeable) to diffusion of typically encountered ground water contaminants (MTBE, etc.) through the barrier material. Examples of acceptable barrier material compositions are thin films made of Mylar® material, Teflon® material, or PVDF polymers. Further, these thin films optionally may be coated with a thin metal deposit to further reduce their diffusion coefficients for many ground water contaminants. The advantage of the thin films is that they do not change significantly the ability to evert the flexible liner into the bore hole. Also, since some flexible liners (like that of FIG. 1) may be simply lowered into the borehole and then inflated with an appropriate fluid or gas (e.g., water or air), the thin diffusion barriers do not add significant bulk to the assembly to impede its being lowered into an open borehole.

Attention is returned to FIG. 1. A borehole 1 in a geologic medium 2 is lined with a liner 3. The interior of the liner 3 is filled with water, or other suitable fluid, to a working level 13 that is higher than the ambient formation level 14 (e.g., the natural water table). The liner 3 is filled to a sufficient working level 13 elevation to provide a liner interior pressure which is greater than the hydraulic pressure within the formation 2, thus urging the liner against the bore hole wall. This pressing of the liner 3 against the inside of the bore hole 1 affects a seal of the borehole 1, preventing migration of ground water into the borehole volume.

For the sake of clarity, FIG. 1 shows a single ground water sampling interval, associated with a spacer 4. Practice of the present methods, however, is not necessarily so limited, and multiple sampling intervals are certainly possible and within the scope of the present techniques. The sampling system shown consists of the spacer 4 which defines the interval of the borehole 1 not sealed by the liner 3. As the spacer 4 prevents the liner 3 from sealing a length of borehole corresponding to the spacer, fluid may migrate from the adjacent formation 2 into the interstitial volume within the spacer 4. Details of the spacer 4 are described further hereafter.

Fluid in the interstitial space or volume of the spacer 4 is conducted through the sealing liner 3 via a port 5. Fluid flow is further conducted through a first conductor tube 6, through a check valve 7, and into a second, larger diameter, pressure tube 8. Flow into the pressure tube 8 fills that pressure tube to a pressure tube fluid level 10 approximately equal to the formation level 14. A smaller return tube 9 is in fluid communication with the interior of the pressure tube 9. The fluid, which originated in the spacer 4, also rises in the smaller diameter return tube 9 to an equilibrium level corresponding approximately to the pressure tube fluid level 10.

Gas pressure, from any suitable source (not shown; but, for example, compressed air or an inert gas from an above-ground pump or pressure vessel), is applied to the top of tube 8 via a suitable connection fitting 11. This externally supplied gas pressure forces the fluid downward in the pressure tube 8, which closes the check valve 7. The fluid therefore is forced to flow up the smaller-diameter return tube 9 to a container 12 (i.e., on the surface). This simple gas displacement pumping system thus is harnessed to draw water from the geological formation 2 at the spacer location 4.

Reference is made to FIG. 2, which supplies details of the spacer 4. As suggested by the figure, the spacer may be generally annular with an outside diameter approximately corresponding to the diameter of the bore hole (and of the filled liner 3), and surrounds the liner around its circumference. The spacer 4 has an outer layer 15 and an inner permeable layer 16, which are suitably attached to the exterior of the liner 3 at the top and bottom of the spacer 4. The spacer 4 thus provides a permeable surround on the exterior of the liner 3, which allows fluid (i.e. pore water) to be drawn from the formation 2 through the wall of the borehole 1 where it is in contact with the spacer 4. The fluid flows through the permeable layer 16 and is conducted to the port 5. Passing the port 5, the fluid moves into the tube 6, and then to the overall pumping system (including elements 7-12 depicted in the drawings) for sampling, etc.

The combined spacer and pumping system (collectively, drawing elements 4-12) may be reproduced at, and for, different spacer 4 elevations along a single sealing liner 3. These several sampling subsystems are gathered into a tubing bundle in the interior of the borehole 1. Very preferably, the pore fluid in the geologic formation 2 at any particular sample interval and port (4, 5) is not connected via the borehole 1 with the fluid being sampled at any other, different, port at a higher or lower elevation in the formation 2. Advantageously, the pressurized liner 3 seals the borehole 1 between multiple sampling intervals situated within in the same borehole.

Figure 3:
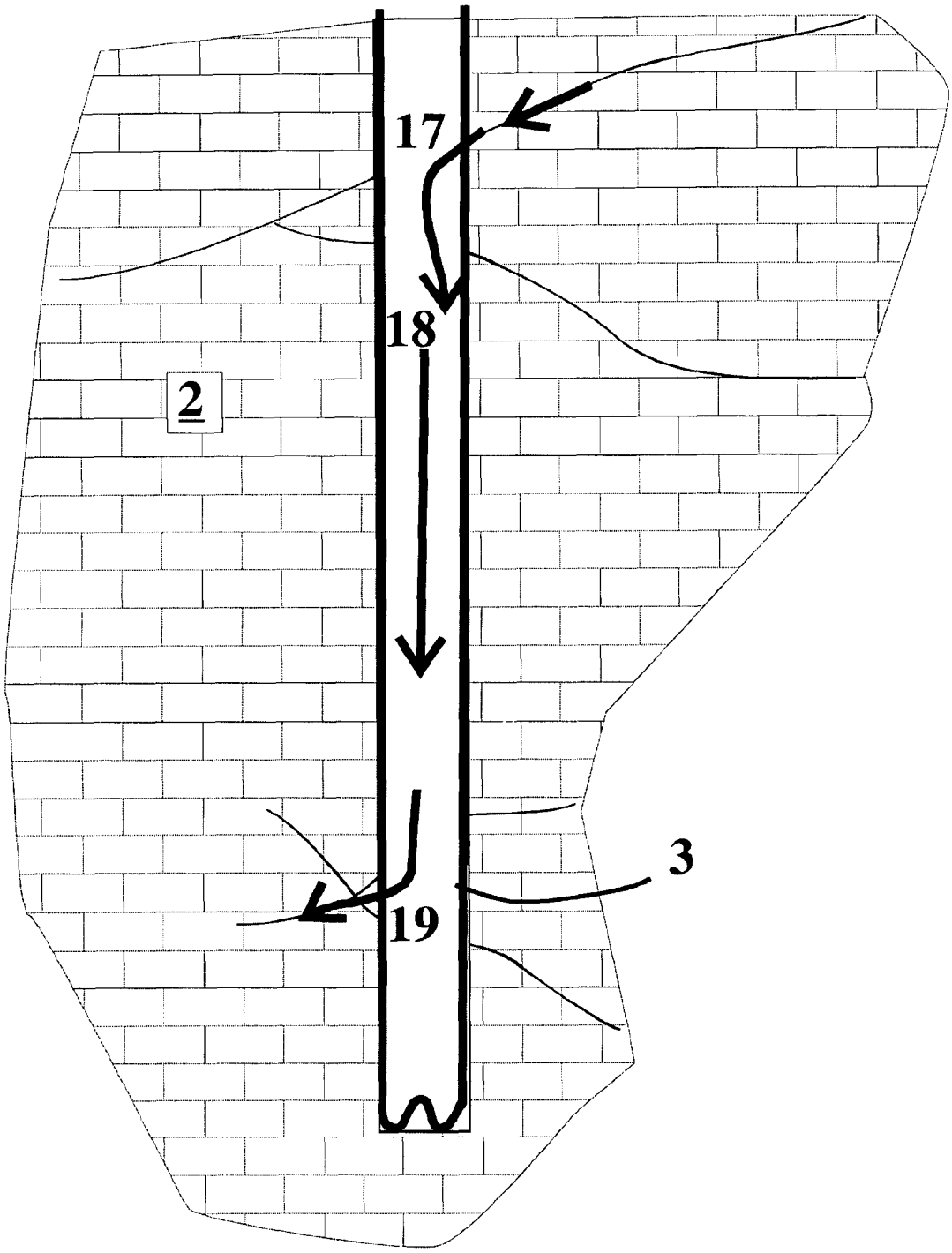
FIG. 3 is a schematic sectional view of a bore hole, showing a typical potential diffusion path of concern between adjacent spacers in a liner system according to the present disclosure.

However, a potential problem to be avoided is that the fluid-filled interior of the liner 3 may provide a pathway for contamination at one sampling elevation (4) in a bore hole to propagate to another, different elevation in the same bore hole. Such a possible pathway is shown with directional arrows in FIG. 3. The pathway is provided by the slow diffusion of contamination from the ground water at one elevation (e.g., elevation 17), through the liner 3, into the fluid fill of the liner, then along the fluid-filled interior 18 of the liner, and out through the liner into the formation 2 at a second elevation (e.g., elevation 19). While this diffusion process usually is very slow, in some situations of very high contamination at a particular spacer elevation, a significant amount of contamination can occur, by means of diffusion, at an adjacent sampling location—which otherwise may not produce any contaminated water.

Figure 4:
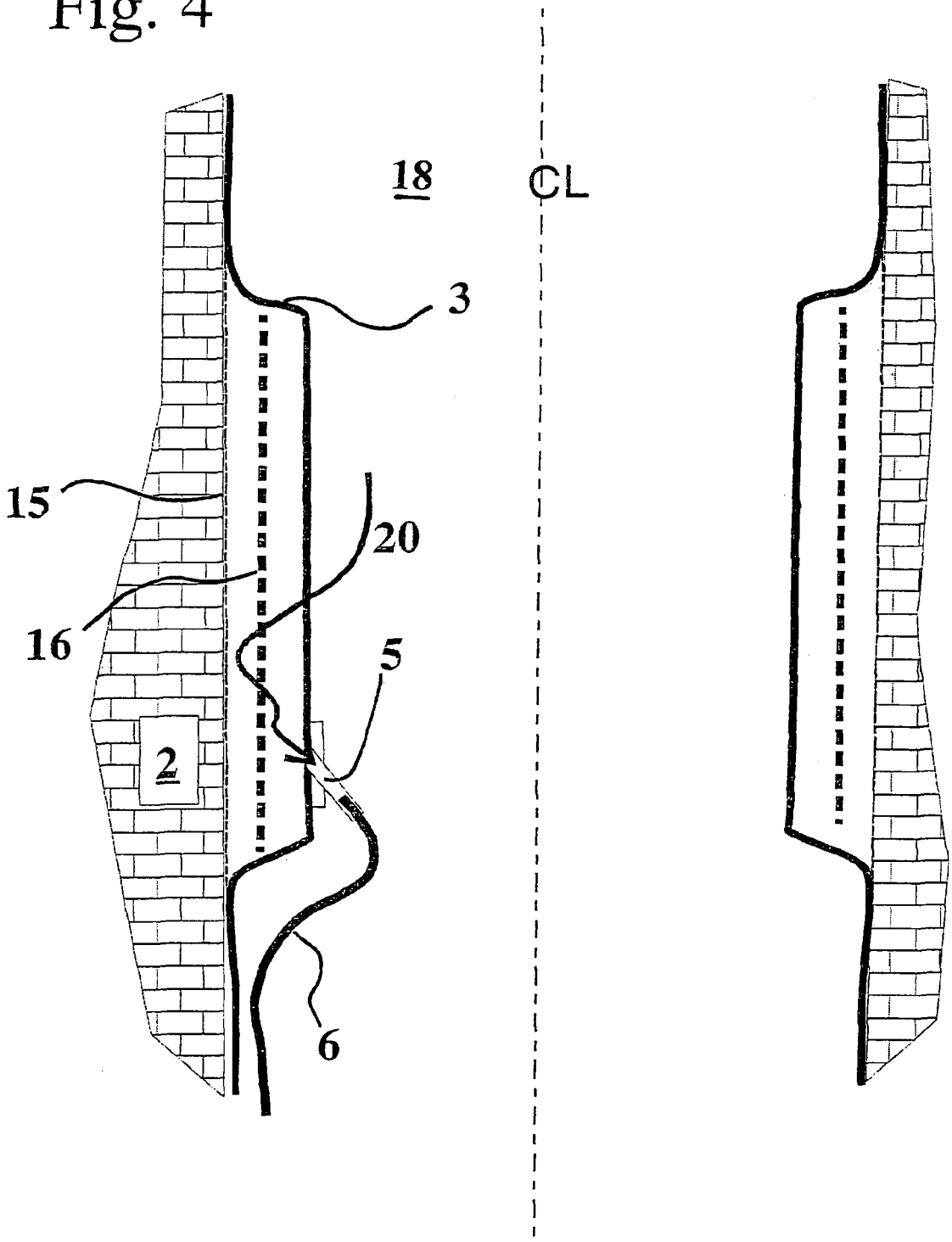
FIG. 4 is an enlarged side sectional view of a portion of a liner system, depicting a diffusion path directly through the liner material into the fluid of the interstitial space inside a spacer volume, and showing a possible location of a port in the liner for fluid collection.

Reference now is invited to FIG. 4. A spacer 4 is shown situated between the liner 3 and the wall of the bore hole in the formation 2. A substantial threat to pore fluid (e. g., ground water) integrity is the diffusion of contamination from the fluid fill within the interior 18 of the liner 3 into the interior volume of the spacer 4. FIG. 4 illustrates with an erratic directional arrow the short diffusion path 20 through the liner 3 into the spacer volume. It is observed that there is very short diffusion distance from the liner interior 18 on through the liner, into the interstitial space of the spacer coarse mesh 16, and then into the port 5. Consequently, the diffusion of contamination from the fluid-filled interior 18 of the liner 3 potentially may violate the integrity of the fluid sample (conducted toward the port 5) as being representative of fluid in the adjacent formation 2.

To maximize sampling reliability, therefore, it is needful to prevent contaminations such as those just described. One simple expedient would be to fill the liner 3 with a lean cement or perhaps with a bentonite slurry. However, such fill materials may prevent or complicate the installation or removal of the liner 3. (Again, the installation and removal of a liner system, liner inversion, is taught in U.S. Pat. No. 6,910,374.) A central aspect of the disclosed apparatus and method is to provide a diffusion barrier to prevent such deleterious cross-communications, by diffusion along the interior of the liner, between separate sampling intervals.

Figure 5:
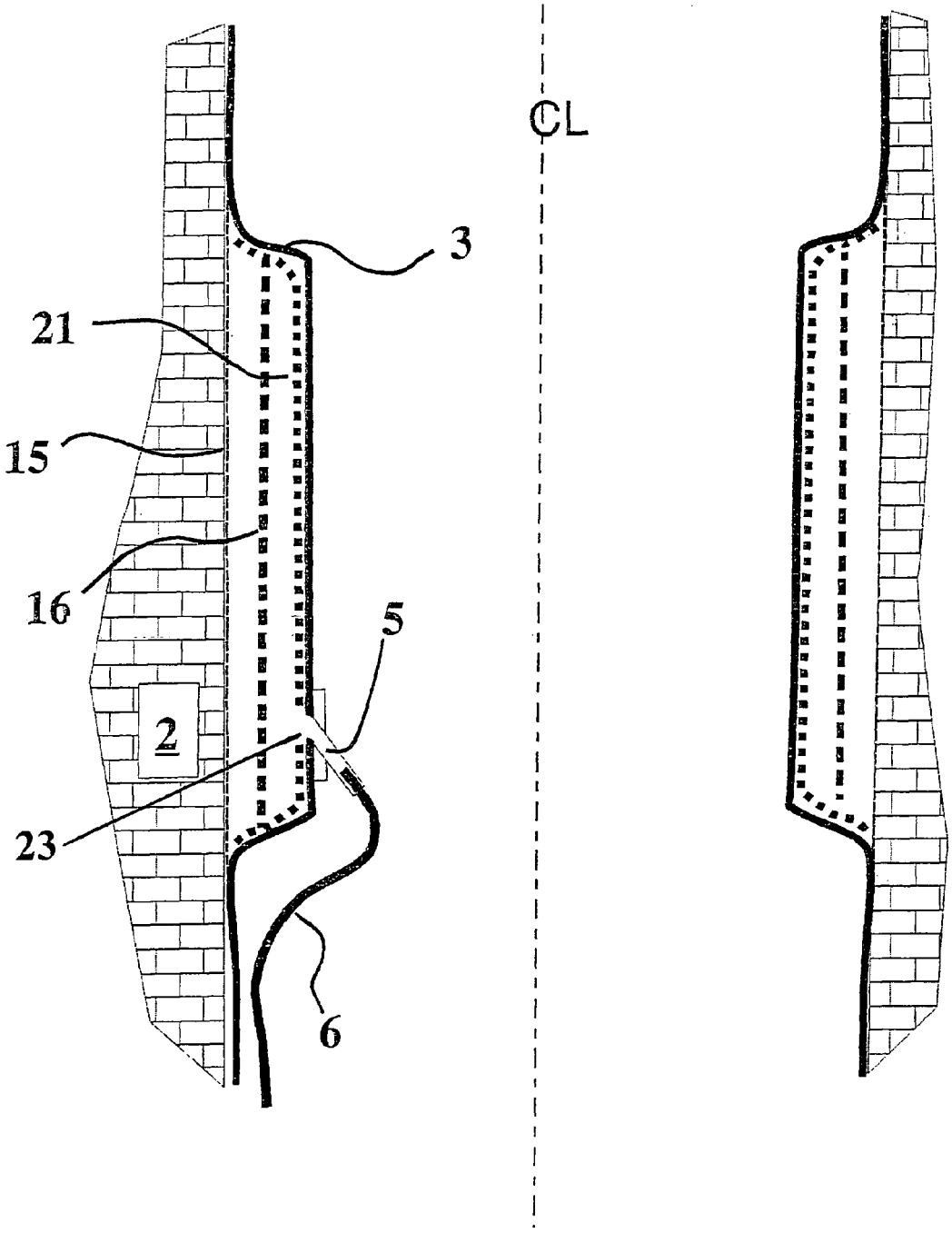
FIG. 5 is an enlarged, schematic sectional view of a spacer and diffusion barrier according to this disclosure, as they are in place in a bore hole, showing the elements of an outer filter layer, an intermediate mesh for fluid flow, and the inner diffusion barrier.
Figure 6:
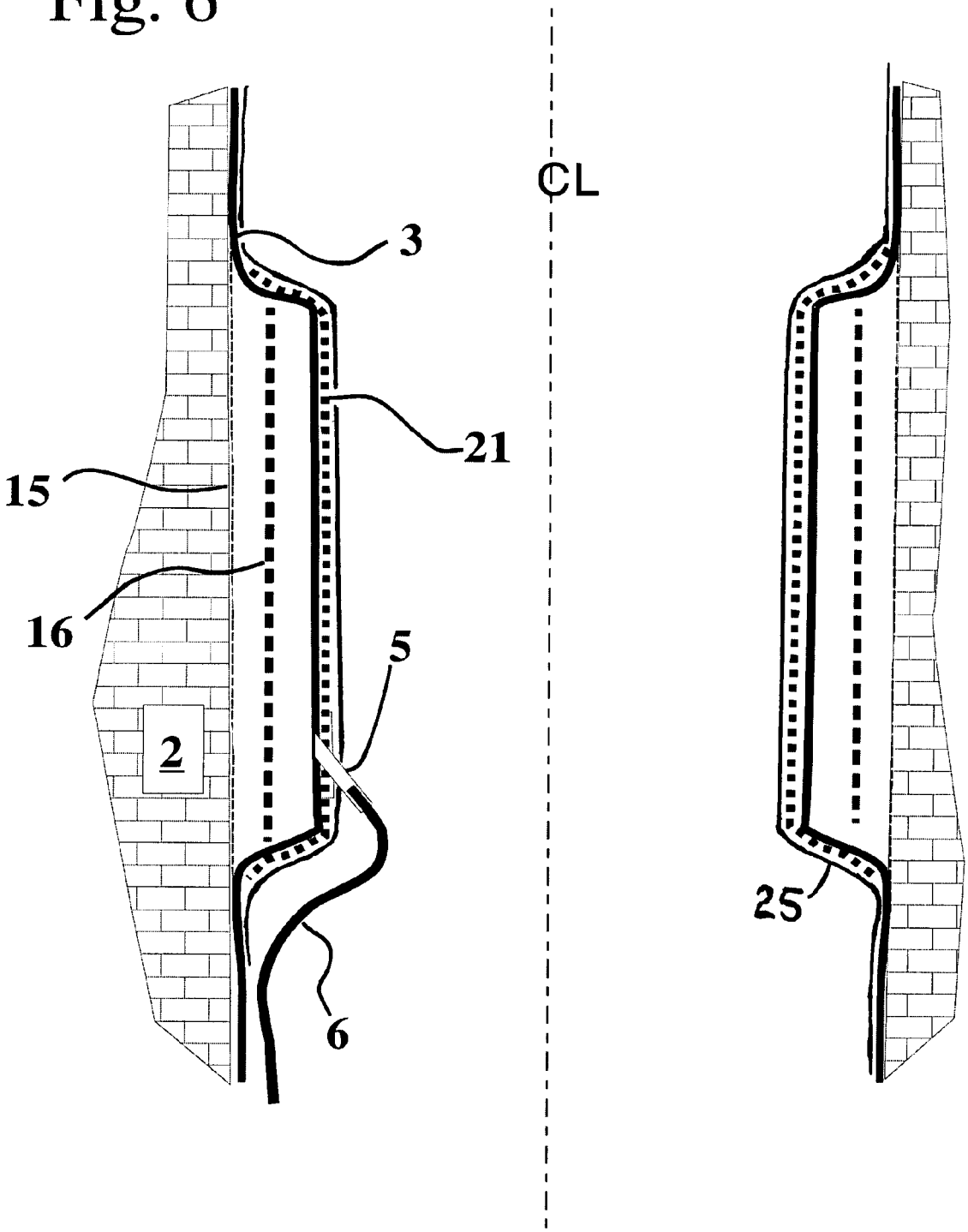
FIG. 6 is an enlarged, schematic sectional view of an alternative configuration of the spacer and diffusion barrier according to this disclosure, as they are in place in a bore hole, showing the elements of an outer filter layer, an intermediate mesh for fluid flow, and the diffusion barrier disposed within the interior of the liner.

Reference is made to FIG. 5, showing the geometry of the spacer 4 with a diffusion barrier 21 generally exemplary of the embodiments of this disclosure. In the preferred embodiment, the diffusion barrier 21 is securely affixed to the exterior surface of the liner 3, although possible alternative embodiments (by more challenging fabrication) could feature a diffusion barrier attached to the inside of the tubular liner 3 (FIG. 6). The height (axial) and location of each barrier 21 in a system correspond, relative to the liner 3, to the location of a sampling interval associated with a spacer 4. The diffusion barrier 21 may be a thin, annular, film cylinder having a diameter approximating the diameter of the liner 3. The barrier 21 may be attached by adhesives, welding, or other suitable means known in the art, to the liner at each location along the liner length corresponding to the locations of a spacer 4. In alternative possible configurations, the barrier 21 is joined directly to the spacer 4, while yet being situated between the spacer and the liner exterior, in addition to or lieu of attachment to the liner.

Reference to FIG. 6 illustrates that, in a less desirable alternative embodiment, the diffusion barrier 21 may be connected to the interior of the liner 3. Like the preferred embodiment, the barrier 21 may be generally annular, and connected to the liner so to be in proximity to, and of generally corresponding axial dimension with, the spacer assembly 4. FIG. 6 also shows the provision of a thin metal film 25, as previously discussed herein as being optionally available to enhance barrier impermeability in any embodiment on either side (or even within) the liner 3. A person of ordinary skill in the art will immediately appreciate that the diffusion barrier alternatively may be a continuous layer upon the interior surface of the liner 3, throughout the liner's length.

Thus, each spacer 4 on the liner 3 has a diffusion barrier 21 associated therewith. Each diffusion barrier 21 prevents the diffusion of water in either direction through the liner. Further, contaminants within the liner itself are prevented from leaching from the liner into fluids contacting the liner. This barrier 21 makes the normal flexible liner sampling system better able to produce ground water, or a pore gas sample, more representative of the in situ nature of those fluids within the formation 2. However, the barrier 21 has a passage there through, in registration and communication with the port 5, for the sample fluid to flow from the spacer 4 through the liner 3 and on to the tubing 6 inside the liner system.

The diffusion barrier 21 therefore prevents the diffusion of contaminants both into and out of the interior, filled, volume 18 of the liner 3. Incorporating this barrier 21 into the practice of the apparatus and method enables a flexible liner sampling system better able to a produce ground water, or a pore gas sample, more representative of the true in situ nature of such fluids. A passage 23 through the barrier 21 allows the sample fluid to flow directly from the permeable mesh 16 into the port 5.

The diffusion barrier 21 preferably is fabricated from a thin, flexible, sheet of material very resistant to diffusion of typical ground water contaminants. The diffusion barrier preferably is fabricated and composed from polymers or polymer composites. Examples of possible barrier materials are thin films made of Mylar® material, Teflon® material, or PVDF polymers. Further, a thin barrier 21 may be coated on one or both sides, in any suitable manner, with a thin metal deposit to further reduce their diffusion coefficients for many ground water contaminants. An advantage of such thin films is that they do not significantly affect the ability of a flexible liner 3 to be everted into a borehole. Also, since some flexible liners 3, such as that of FIG. 1, may be lowered into the borehole and then inflated with an appropriate fluid or gas (e.g., water or air), the thin diffusion barriers do not add significant bulk to the overall assembly (thereby impeding its being lowered into an open borehole).

In many installations in fractured rock boreholes, the only portion of a liner 3 with a large surface area exposed to the diffusion of contaminants is the liner portion adjacent to a spacer 4. In such an instance, the diffusion barrier 21 may not be necessary over the entire liner surface, and throughout its length. Still, a diffusion barrier 21 optionally may cover the entire outer, or inner, surface of the liner 3.

The diffusion barrier 21 may be heat welded to the base of the port 5 to provide a good seal between the diffusion barrier and the interior of the port. The apparatus tubes, 6, 8, and 9, preferably are PVDF tubing, which also is a good diffusion barrier against the transport of contamination from the fluid in the liner interior 18 to the interior of the tubing.

A method according to this disclosure is evident from the foregoing. By this technique, a user is provided a mode of sampling, at at least one selected location, the fluid from a material 2 surrounding a bore hole 1. The method features the steps of disposing by eversion a flexible liner 3 down the bore hole 1, situating a spacer 4 outside the liner 3 and in the borehole 4 to create a spacer volume at each of the selected locations, permitting the fluid to be sampled to move (as by gravity flow) from the material 2 and into the spacer's volume, and sealing the liner 3 against contaminant diffusion, to or from the fluid in the spacer volume, through or from the liner 3. The step of sealing the liner 3 includes attaching the flexible diffusion barrier 21 to the interior, or more preferably the exterior, of the liner. Also, attaching the diffusion barrier 21 may mean surrounding the liner 3 with an annularly shaped diffusion barrier in the immediate vicinity of the spacer 4. A thin metal film layer may be disposed, by known deposition techniques, upon either or both sides of the diffusion barrier 21 to enhance its impermeability to contaminants. In a very sophisticated embodiment, the thin metal film may be provided within a multi-ply liner. Fluid from the formation 2 is permitted to flow into the spacer volume, and then to move from the spacer volume through an associated port 5 in the liner 3. As mentioned an optional additional step of the process may be disposing a mud filler, especially a pollutant-absorbing mud, into the volume 18 within the liner interior.

An additional potential benefit of a diffusion barrier 21 material, especially with a metal film coating, is the reduction of the liner's friction with itself. In one embodiment, the diffusion barrier 21 covers the entire exterior (or interior) surface; providing a diffusion barrier having a coefficient of friction lower than the coefficient of the liner itself reduces the minimum pressure required to evert the liner system into a passage such as a pipe or borehole. Especially with a thin metal film layer (on the barrier 21) having a coefficient of friction less than a coefficient of friction of the liner material, the internal pressure required to evert the liner down said bore hole is significantly reduced.

It also is noted that the liner materials, in a liner 3, sometimes contain toluene which substance may be leached into fluids contacting the liner, and thus is detected in the fluid (e.g., water) sample chemical analysis. Disposing the diffusion barrier 21 on the exterior of the liner 3 can prevent such extraneous chemical compounds from being leached from the liner 3 material into water or other fluid adjacent to the liner.

Testing has shown that the use of a diffusion barrier 21 as described reduces the diffusion rate through the liner 3 to less than 1% of the rate without the barrier. This implies that the diffusion rate into, and then out of, the liner through two barriers is about ~0.01% of the rate without a barrier 21.

In some situations, the liner 3 is located in very porous geologic media where significant contaminant diffusion through the liner can occur anywhere along the borehole 1. In such a case, the diffusion barrier 21 preferably is provided as a complete external covering of the liner 3. In another embodiment providing the same function, the diffusion barrier 21 may be an inside layer, bonded to the inside surface of the liner 3 in any suitable manner to prevent the diffusion into or out of the liner interior 18. However, an interiorly disposed diffusion barrier 21 does not offer the advantage of preventing chemical leaching from the liner material into the fluid sample.

Another application of the foregoing flexible diffusion barrier is to form an inflatable balloon of the diffusion barrier material within the liner, to prevent longitudinal migration of contaminants inside the liner. Such a diffusion barrier balloon design is a useful improvement to earlier liner designs which lack an external barrier to diffusion. A series of deflated balloons of the barrier material can be lowered, on an inflating tube, into the liner interior and then inflated to discourage longitudinal diffusion along the interior of a liner.

Yet another option is to use the diffusion barrier as an external cover on a second liner that is everted into the interior of a liner already in position in the borehole. The interior concentric liner would prevent, or reduce, diffusion along the interior of the first liner without the need to remove the first liner.

The efficacy of the diffusion barrier apparatus and method optionally is enhanced by the inclusion and use of a suitable mud fill of the liner. Such a fill, which may be a bentonite slurry or like fillers known in the art, further retards the diffusion of contaminants along the length of the bore hole liner. The fill is disposed within the liner interior, while the diffusion barrier may be on the inside or outside of the liner. This advantageous combination provides increased prevention of deleterious contaminant diffusion, above and beyond the measure of protection otherwise provided by either method alone. Such a mud fill may feature absorptive ingredients (which may occur naturally in many types of clay, or which may be absorptive additives to the mud at or near the time of liner filling. Mud fillers featuring absorptive capacities greatly retard diffusion inside the liner. The mud often, but not necessarily, may be pumped into the liner interior so to fill it from the bottom toward the liner top, thereby displacing the (more typical) water fill in the liner.

Accordingly, providing flexible liner systems with diffusion barriers, as described, addresses a leading concern regarding potential diffusion transport of contaminants. Undesirable contaminant transfer, by way of the interior of the liner, from one sampling elevation to another is ameliorated or eliminated entirely.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all patents cited above are hereby incorporated by reference.

What is claimed is:

1. A method of sampling, at selected locations, a fluid from a material surrounding a bore bole, comprising the steps of:

providing a flexible tubular liner;

attaching at least one spacer to the liner, each said spacer having a spacer volume therein;

affixing a flexible diffusion barrier directly to the liner in the vicinity of each of said at least one spacer;

after said providing, attaching, and affixing steps, then disposing the flexible liner by eversion down the bore hole to situate a spacer outside the liner but in the borehole at each selected location in the borehole, thereby placing a spacer volume at each selected location;

permitting the fluid to move from the material and into at least one said spacer volume; and sealing the liner, by the diffusion barrier, against contaminant diffusion, to or from fluid in the spacer volume, through the liner.

2. A method according to claim 1 comprising affixing the flexible diffusion barrier to an exterior of the liner.

3. A method according to claim 1 comprising affixing the flexible diffusion barrier to an interior of the liner.

4. A method according to claim 2 wherein affixing the diffusion barrier comprises surrounding the liner with an annular diffusion barrier in the immediate vicinity of each spacer.

5. A method according to claim 1 wherein affixing the diffusion barrier comprises providing a barrier comprising a polymer composite film.

6. A method according to claim 1 further comprising the step of disposing on or within the barrier a thin metal film layer.

7. A method according to claim 1 wherein sealing the liner further comprises joining the flexible diffusion barrier with the spacer.

8. A method according to claim 1 further comprising the step of permitting fluid to move from the spacer volume through an associated port in the liner.

* * * * *